US006383296B1

(12) United States Patent
Burgard

(10) Patent No.: US 6,383,296 B1
(45) Date of Patent: May 7, 2002

(54) CHAMBERED DOCTOR BLADE WITH AUTOMATIC CLEANUP AND INK REPLACEMENT

(75) Inventor: Robert L. Burgard, Roseville, CA (US)

(73) Assignee: Harris & Bruno Machine Co., Roseville, CA (US)

( * ) Notice: Subject to any disclaimer, the term of this patent is extended or adjusted under 35 U.S.C. 154(b) by 0 days.

(21) Appl. No.: 09/444,666

(22) Filed: Nov. 22, 1999

(51) Int. Cl.[7] ..... B05C 1/08

(52) U.S. Cl. ..... 118/683; 118/684; 118/696; 118/712; 118/46; 118/413; 118/259; 118/261

(58) Field of Search ..... 118/683, 684, 118/696, 712, 46, 262, 259, 413, 414, 261; 101/350.1, 350.5, 366, 425, 483

(56) References Cited

U.S. PATENT DOCUMENTS

| | | | | |
|---|---|---|---|---|
| 3,974,768 A | | 8/1976 | Grobman | 101/425 |
| 4,066,014 A | * | 1/1978 | van Haaften | 101/350.1 |
| 4,527,479 A | | 7/1985 | Dahlgren et al. | 101/450.1 |
| 4,643,124 A | | 2/1987 | Switall | 118/259 |
| 4,737,378 A | | 4/1988 | Narita et al. | 427/8 |
| 4,821,672 A | | 4/1989 | Bruno | 118/261 |
| 4,822,647 A | | 4/1989 | Nozaki et al. | 427/421 |
| 5,003,876 A | * | 4/1991 | Harrison et al. | 101/350.1 |
| 5,005,478 A | | 4/1991 | Goldbert et al. | 101/425 |
| 5,010,817 A | | 4/1991 | Grosshauser | 101/350.1 |
| 5,054,392 A | | 10/1991 | Greenwood | 101/142 |
| 5,103,730 A | | 4/1992 | Sarda | 514/202 |
| 5,207,159 A | | 5/1993 | DeMoore et al. | 101/350.1 |
| 5,213,044 A | | 5/1993 | Elia et al. | 101/483 |
| 5,273,583 A | | 12/1993 | Langlois et al. | 118/665 |
| 5,330,576 A | | 7/1994 | Clauditz | 118/688 |
| 5,367,982 A | | 11/1994 | DeMoore et al. | 118/46 |
| 5,410,961 A | | 5/1995 | DeNicola et al. | 101/363 |
| 5,425,809 A | | 6/1995 | Person | 118/264 |
| 5,570,633 A | * | 11/1996 | Schultz et al. | 101/484 |
| 5,683,508 A | | 11/1997 | Bleiler et al. | 118/46 |
| 5,816,163 A | * | 10/1998 | Achelpohl et al. | 101/483 |
| 5,915,302 A | * | 6/1999 | Baba et al. | 101/366 |
| 6,012,391 A | * | 1/2000 | Weishew | 101/424 |
| 6,041,709 A | * | 3/2000 | Wells et al. | 101/366 |

FOREIGN PATENT DOCUMENTS

| | | |
|---|---|---|
| JP | 60196348 | 10/1984 |

* cited by examiner

*Primary Examiner*—Laura Edwards
(74) *Attorney, Agent, or Firm*—Harris Zimmerman, Esq.

(57) ABSTRACT

A chambered doctor blade apparatus provides an automatic system for cleanup and replacement of ink or coating substance, as well as operating a hydraulic head loading system that includes hydrostatic compensation, and integrates the head loading mechanism into the automated cleaning, flushing and replacement cycle. A supply pump, a return pump, and a plurality of lines are connected by electrically operated valves. A programmable logic controller (PLC) is connected through a display driver to a touch screen display that presents an interactive graphical user interface for control purposes. The PLC is programmed to carry out sequentially the required steps for cleaning, refilling, and running the chambered doctor blade assembly. The PLC is connected to each of the pumps and valves, and to the head loading valve of a hydrostatically compensated hydraulic head loading system. The hydraulic head loading system includes a hollow pivot tube extending parallel to the length of the doctor blade chamber and mounted on a coaxial pivot shaft. A plurality of hydraulic cylinders, each having a rolling diaphragm piston mounted therein, are spaced along the back panel of the doctor blade chamber, with each piston secured to the back panel. Each cylinder is rigidly secured to the pivot tube, and the pivot tube also serves as a manifold to supply hydraulic fluid to the cylinders.

20 Claims, 7 Drawing Sheets

| Procedure | Valve 102 | Valve 103 | Valve 109 | Valve 111 | Valve 117 | Valve 118 | Valve 122 | Valve 123 | Valve 127 | Pump 124 | Pump 126 | Valve 59 |
|---|---|---|---|---|---|---|---|---|---|---|---|---|
| Stop | NC | NC | NC | NC | NC | NC | NC | O | NC | OFF | OFF | OFF |
| Ink Purge | O | NC | NC | NC | NC | O | NC | NC | O | F | F | O |
| Ink Fill | O | O | NC | NC | NC | NC | NC | NC | NC | F | F | O |
| Ink Running | O | O | NC | NC | NC | NC | NC | NC | NC | R | R | O |
| Ink Drain | O | O | NC | NC | NC | NC | NC | O | O | F | F | O |
| Water Rinse | NC | NC | O | NC | NC | O | NC | NC | NC/O | F | F | O |
| Water Drain | NC | NC | O | NC | NC | O | NC | O | O | F | F | O |
| Recirc. Wash | NC | NC | NC | O | O | NC | NC | NC | NC/O | W | W | O |
| Recirc. Drain | NC | NC | NC | O | O | NC | NC | O | O | F | F | O |
| Injection Wash | NC | NC | O | NC | NC | O | O | NC | NC/O | W | W | O |
| Water Rinse 2 | NC | NC | O | NC | NC | O | NC | NC | NC/O | W | W | O |
| Water Drain 2 | NC | NC | O | NC | NC | O | NC | O | O | F | F | O |

F= Fill Speed R=Run Speed W=Wash Speed NC=closed O=open

NC/O = closed, delayed open

FIG. 10

CHAMBERED DOCTOR BLADE WITH AUTOMATIC CLEANUP AND INK REPLACEMENT

BACKGROUND OF THE INVENTION

In the application of liquid substances to a moving web of material, it is considered well known in the art to apply the liquid using a rotating transfer roller, and to directly apply the liquid uniformly onto the roller by means of a doctor blade assembly. The doctor blade assembly generally includes a reservoir chamber extending the length of the transfer roller and in contact with the circumferential surface thereof, and a pair of doctor blades extending longitudinally on either side of the chamber. The doctor blades are angled obliquely toward the transfer roller surface, and serve both to seal the reservoir chamber to the roller and to form a uniform film of liquid on the roller transfer surface. The assembly also must include some means to seal the reservoir chamber at the ends of the roller, so that the liquid is not flung from the roller into the surroundings, and so that the liquid may be pumped through the reservoir during the transfer process. Such transfer systems are used in flexographic and gravure printing, adhesive applicators in the paper converting industry, coating applicators in many different industrial processes, and the like. An exemplary system is described in U.S. Pat. No. 4,821,672, issued to Nick Bruno on Apr. 18, 1989.

Chambered doctor blade devices are generally employed with large printing presses or paper converting machines, either of which comprising a substantial capital investment. The forces of economics dictate that these machines be used productively to the greatest extent possible. Any downtime is considered to be a diminishment of return on investment, to be avoided whenever possible.

It is often necessary to change the ink or coating compound that is applied by the chambered doctor blade apparatus, due to color change or alteration of the machine setup. Typically, the ink reservoir, supply lines, valves, and inking chamber must be drained, flushed, cleaned, and resupplied with a new ink or coating compound. The time spent in carrying out these tasks comprises machine downtime, a loss in productivity. Automated systems for supplying a doctor blade chamber are known in the prior art, and include some draining and flushing features. These systems also enable the transfer roller to be cleaned by the doctor blade assembly as it cleans itself, shrinking the labor requirement of the cleaning and refilling process. It is highly desirable for an automated system to drain, flush, and clean all of the supply lines and fittings, whereby contamination from a former machine setup is removed before a new setup is created. One such system, depicted in U.S. Pat. No. 5,638,508, describes a doctor blade coating system which purports to automate the wash and clean cycle in addition to supplying the coating chamber. However, this system typifies the prior art in that it does not route the washing and flushing liquids through the same lines and fittings that deliver the ink or coating substances. As a result, some components such as the supply pump and supply lines, and the associated connectors are not cleaned before a new ink color or coating is introduced into the system.

It is also known that chambered doctor blade devices rely on doctor blades impinging on a transfer (anilox) roller to form a smooth and uniform film of ink or coating substance on the roller. The doctor blades are required to present a highly linear edge that impinges on the transfer roller with a force that is very uniform along the entire length of the blades (which can extend over 170 inches). Due to vibration and wear, the doctor blade edges may develop areas where the contact force varies along the length thereof, causing uneven distribution of the ink or coating film on the transfer roller.

There is known in the prior art at least one system for urging the doctor blades toward the transfer roller that employs hydraulic cylinders spaced along the apparatus to distribute the loading force therealong. Moreover, the hydraulic system is energized by pneumatic pressure, which provides hydrostatic compensation in the hydraulic circuit that enables each hydraulic piston to advance or retract as necessary to maintain a constant loading pressure against the transfer roller. In addition, the system provides a restricted flow orifice at each hydraulic cylinder, so that each cylinder may resist rapid motion (vibration and the like) while enabling slower adjustability in response to wear conditions. Although this superior doctor blade loading system has bee available in the prior art, it has not been integrated into an automatic cleanup and ink replacement system.

SUMMARY OF THE INVENTION

The present invention generally comprises a chambered doctor blade apparatus that provides automatic system for cleanup and replacement of ink or coating substance. The automatic system also operates a hydraulic head loading system that includes hydrostatic compensation, and integrates the head loading mechanism into the automated cleaning, flushing and replacement cycle. (Hereinafter, reference will be made to the use of ink in a printing process, but it is understood that any coating substance is encompassed by this discussion.)

In one aspect, the invention includes a chambered doctor blade assembly having a supply line connected to one end and a return line connected to the other end. A return pump has an intake connected to the return line, and an output connected through a return valve to a changeable ink reservoir. A supply pump has an output connected to the chamber supply line, and an intake connected through a supply valve to the ink reservoir. The supply pump intake line is also connected to a vent valve, and to a first wash valve that is connected to a first wash tank. The line from the supply valve at the ink reservoir is connected through a first pair of valves to a main water reservoir and a second wash tank. The line from the return valve at the ink reservoir is connected through a second pair of valves to the second wash tank and to a waste discharge outlet. Actuation of these valves and pumps in various combinations and sequences enables all of the valves, fittings, pumps, the doctor blade chamber, and the anilox roller to be drained, flushed, cleaned, flushed, and recharged with fresh ink.

In a further aspect of the invention, the system includes an automated system for controlling the valves and pumps enumerated above to carry out the cleaning and recharging functions also described above. The automated system includes a programmable logic controller (PLC) connected through a display driver to a touch screen display that depicts system conditions and presents an interactive graphical user interface for control purposes. The PLC is connected to a non-volatile memory that stores programming and values to carry out sequentially the required steps for cleaning, refilling, and running the chambered doctor blade assembly. The PLC is connected to each of the pumps and valves, and to the head loading valve of a hydrostatically compensated hydraulic head loading system.

The hydrostatically compensated hydraulic head loading system includes a hollow pivot tube extending parallel to the length of the doctor blade chamber and mounted on a coaxial pivot shaft. A plurality of hydraulic cylinders, each having a rolling diaphragm piston mounted therein, are spaced along the back panel of the doctor blade chamber, with each piston secured to the back panel. Each cylinder is rigidly secured to the pivot tube, whereby the pivot tube supports the hydraulic cylinders and the doctor blade assembly. A handle secured to the pivot tube permits the assembly to be rotated to bring the doctor blades into and out of engagement with the adjacent anilox roller.

The pivot tube also serves as a manifold to supply hydraulic fluid to the cylinders. An hydraulic supply reservoir includes a head space that is connected through a head loading valve to a source of selectively controlled pneumatic pressure, and the fluid is connected to supply the interior of the hollow pivot tube. An hydraulic supply line extends from each hydraulic cylinder to an adjacent fitting extending from the pivot tube to pressurize the cylinders whenever the head loading valve is activated. The pneumatic loading of the hydraulic fluid supplies a constant and uniform pressure to all the cylinders, and further enables the hydraulic fluid to flow bidirectionally and allows each hydraulic piston to advance or retract as necessary to maintain a constant loading pressure against the transfer roller. In addition, the system provides a restricted flow orifice at each hydraulic cylinder, so that each cylinder may resist rapid motion (vibration and the like) while enabling low velocity adjustability in response to wear conditions.

BRIEF DESCRIPTION OF THE DRAWING

FIG. 10 is a chart depicting the operational status of each active mechanical component of the automated system in each step required for filling, running, and cleaning the chambered doctor blade assembly.

DESCRIPTION OF THE PREFERRED EMBODIMENT

Figure 6:
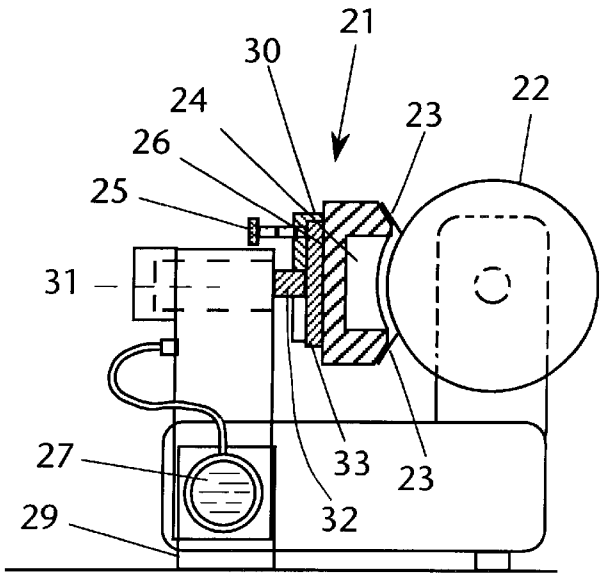
FIG. 6 is a side elevation of the doctor blade assembly and the head loading system of the invention.

The present invention generally comprises a chambered doctor blade apparatus that includes an automatic system for cleanup and replacement of ink or coating substance. With regard to FIGS. 1, 2, and 6, the applicator portion of the invention includes a chambered doctor blade assembly 21 extending parallel to a transfer roller 22 (anilox or equivalent) that engages a printing press, coating applicator, or the like. The assembly 21 includes a longitudinally extending cavity, or chamber 24, and a pair of doctor blades 23 that engage the surface of the transfer roller and form a uniform thin fluid film thereon. The chamber 24 is formed by a channel-like structure having a central web 26 and side walls extending therefrom in parallel, spaced apart relationship.

A hollow pivot tube 27 extends parallel to the central web 26 for substantially the entire length thereof, and is mounted on coaxial pivot shafts 28 which are rotatably supported at opposed ends. A plurality of hydraulic cylinders 31 are mounted rigidly on the pivot tube 27 and spaced longitudinally therealong. Each piston rod 32 of the cylinders 31 is secured to a mounting disk 33, which in turn is slidably received in a receptacle in a bracket 30 secured to the back surface of the central web 26. A lock-down screw 25 secures the disk 33 in the bracket 30. Thus the entire structure 21 is supported by the piston rods 32, which in turn are supported on the pivot tube 27. A handle 34 is secured to the tube 27 to enable rotation of the tube to bring the chambered doctor blade assembly 21 into and out of engagement with the transfer roller 22. At least one shaft lock 36 is also provided to lock the pivot tube 27 and pivot shafts 28 at a fixed angular orientation to secure the apparatus 21 in an engaged or disengaged disposition.

It may be appreciated that the entire head assembly 21 may be removed quickly and easily by loosening all of the screws 25, and sliding the brackets 30 off of the disks 33. Another head assembly 21 may be substituted by reversing this process.

The pivot tube 27 further serves as a manifold to supply low pressure hydraulic fluid to the cylinders 31. An hydraulic supply reservoir 37 is disposed adjacent to the tube 27, and includes a supply line 38 that delivers hydraulic fluid from the reservoir to the interior of the pivot tube 27. The reservoir provides head space above the fluid charge therein, and a pneumatic line 39 connects the head space through a head loading valve to a pressurized gas source having a selectively adjustable pressure in a generally low pressure range. A plurality of supply lines 41 extend from a fitting on the pivot tube 27 to a respective one of the hydraulic cylinders 31. Thus the hydraulic fluid supplied through the interior of the pivot tube 27 to each cylinder is under a constant and uniform pressure, and is free to flow bidirectionally between the reservoir, pivot tube, and cylinders. This feature enables all pistons to exert the same force on the central web of the doctor blade assembly, while each piston is able to extend a variable amount until it meets sufficient mechanical resistance that is equal and opposite to the hydraulic force of the piston. This attribute allows the doctor blade assembly to self-compensate for wear, expansion, and other physical variables in the relationship between the doctor blade assembly and the transfer roller.

Figure 3:
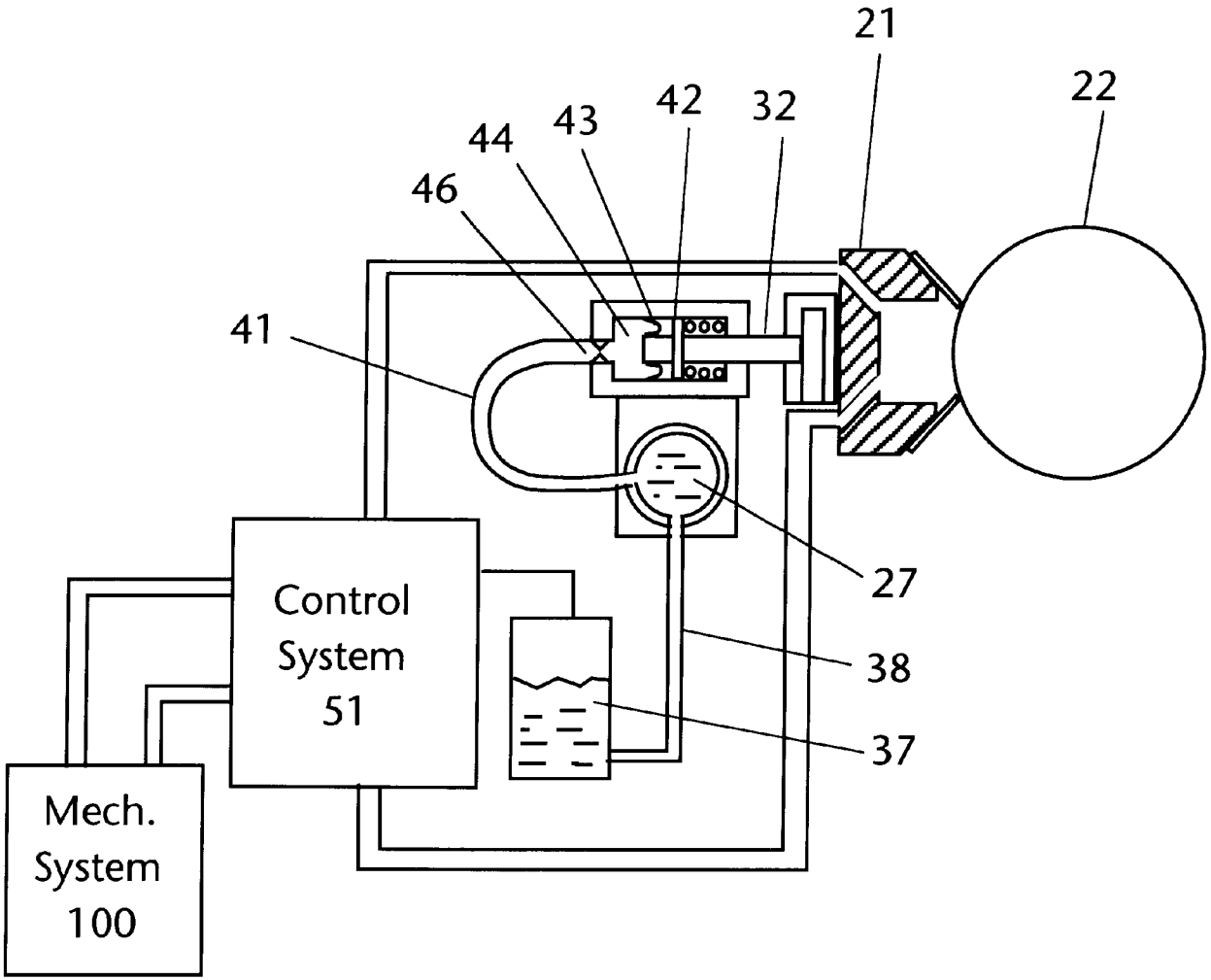
FIG. 3 is a schematic view of the hydrostatically compensated hydraulic head loading system combined with the automatic cleaning and recharging system of the invention.

With regard to FIG. 3, each cylinder 31 includes a piston 42 connected to the piston rod 32, the piston 42 having a rolling diaphragm seal 43. The driving chamber 44 of the cylinder 31 is connected through a restricted orifice 46 to the input of the supply line 41. The restricted orifice 46 prevents the piston 42 from undergoing any high velocity translation, thereby minimizing any response to rapid motion of the doctor blade assembly, such as vibration and the like. On the other hand, the restricted orifice does not inhibit low velocity translation of the piston 42, whereby the system provides self-compensating adjustment to wear and other long-term variables.

Figure 4:
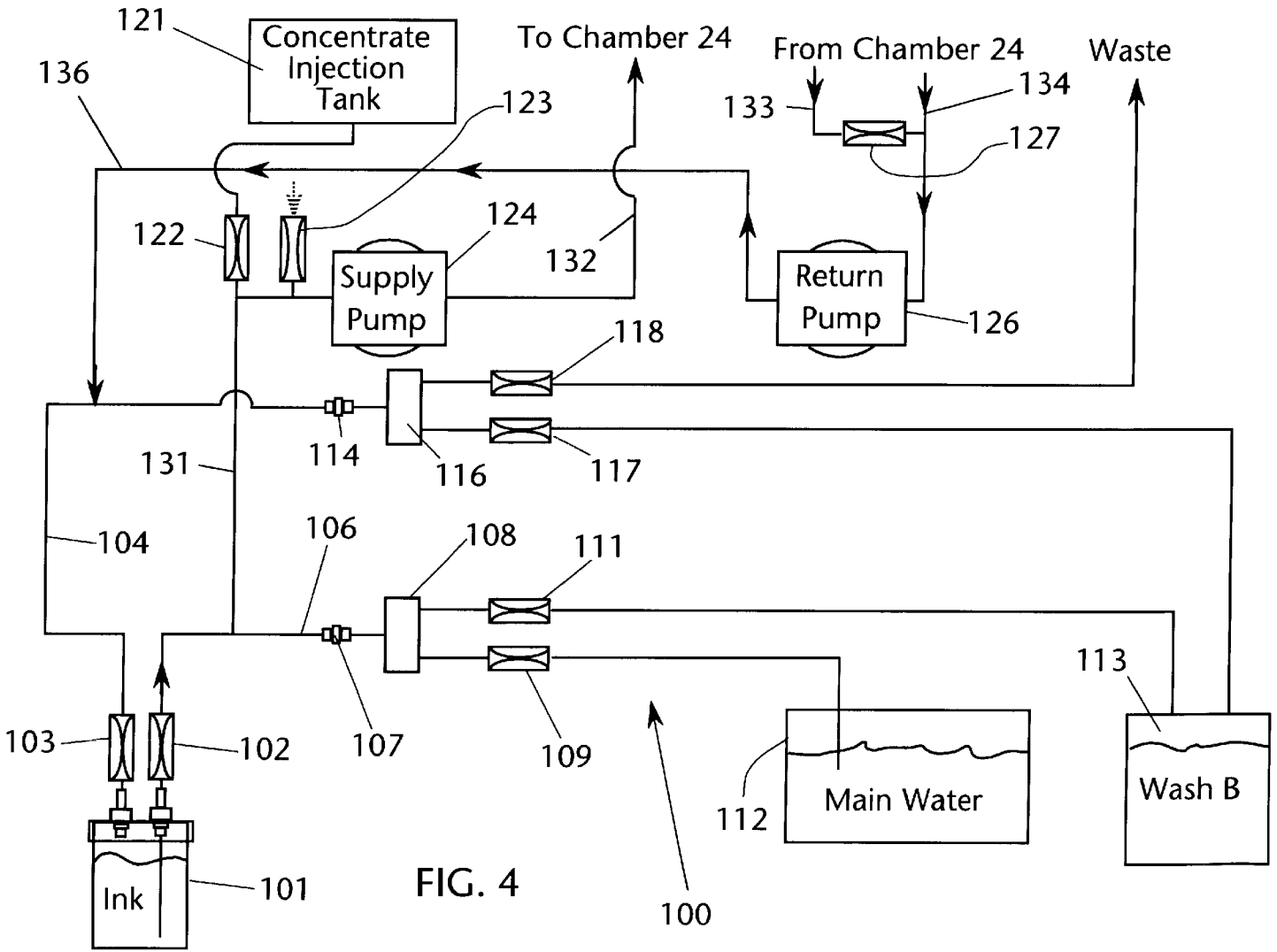
FIG. 4 is a schematic representation of the active mechanical components of the automatic cleaning and recharging system of the invention.

With regard to FIG. 4, the mechanical components 100 of the automated cleaning, filling, and operating system include an interchangeable ink reservoir 101. A draw tube in the reservoir 101 feeds ink (or any other liquid) through a supply valve 102 to a supply line 131. The supply line 131 extends to the intake port of supply pump 124, the output of which is connected through line 132 to the doctor blade chamber. Also connected to supply line 131 is a vent valve 123 which opens to ambient air pressure, and an injection tank supply valve 122 which is in turn connected to the outlet of injection tank 121. Injection tank 121 may contain a cleaning solution (Wash A), such as a low pH or high pH liquid or the like.

Supply line 131 also includes branch 106, which connects through fittings 107 and 108 to a pair of supply valves 109 and 111. Valve 109 is connected to the outlet of tank 112, which contains the main water supply for washing and flushing. Valve 111 is connected to the outlet of wash tank 113, which contains another cleaning solution, such as a high pH liquid. Thus supply valves 102, 109, 111 and 122 may be opened as required to select the liquid that is delivered to the supply pump 124 and thus to the doctor blade chamber 24.

There are two outlet ports from chamber 24, connected to return lines 133 and 134, with a chamber drain valve connecting the two return lines. Line 134 is joined to the intake port of return pump 126, and the outlet of pump 126 is connected through return line 136 and 104 to reservoir return valve 103 and thence to the reservoir 101. Line 104 is also connected through fittings 114 and 116 to a pair of valves 117 and 118. Valve 117 is connected to a return line extending to wash tank 113, and valve 118 is connected to a waste discharge line. Thus return valves 103, 117 and 118 may be actuated as required to direct liquid flow from the chamber 24 to the reservoir 101, the wash tank 113, or to the waste discharge line.

Figure 5:
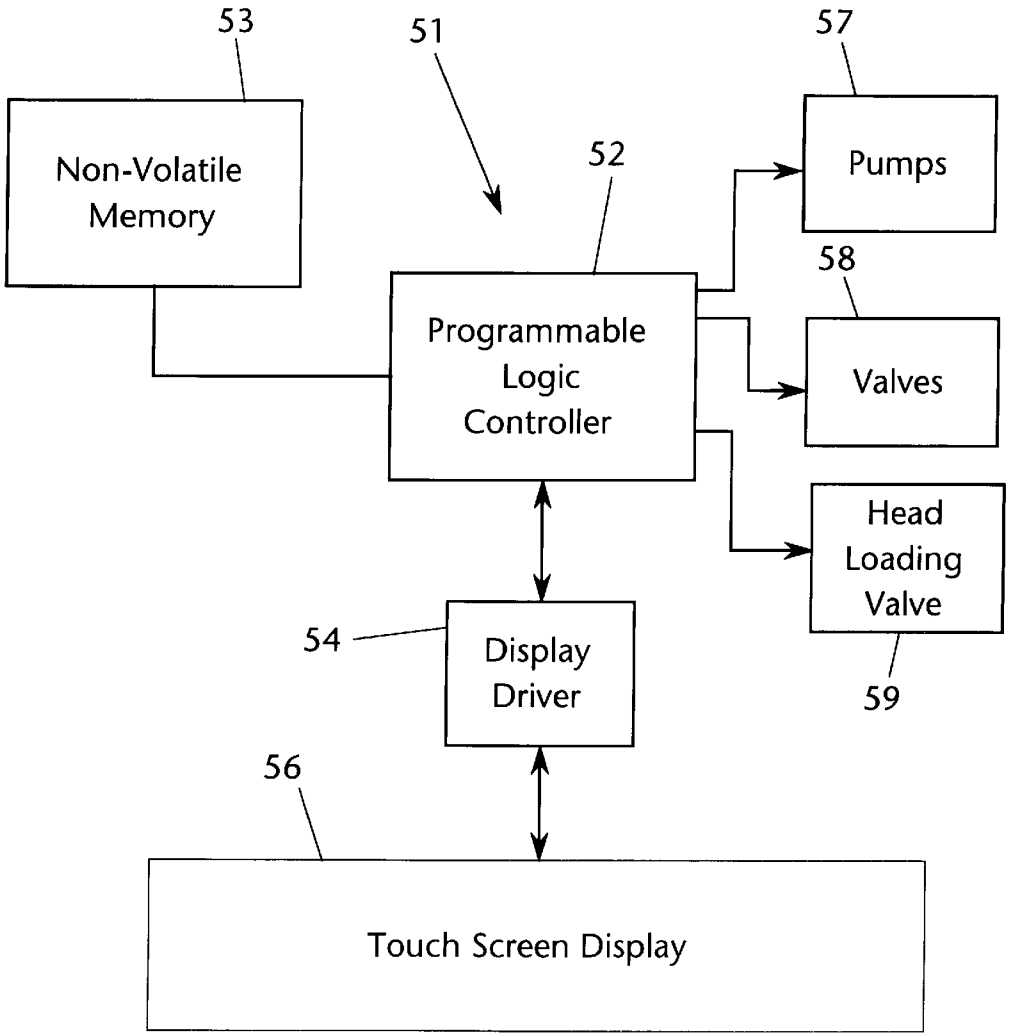
FIG. 5 is a functional block diagram representation of the active electronic components of the automatic cleaning and recharging system of the invention.
Figure 8:
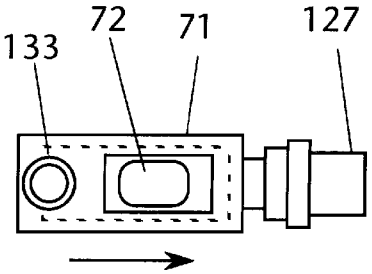
FIG. 8 is an enlarged top view of the drain reservoir valve of the automatic cleaning and recharging system of the invention.

With reference to FIG. 5, the invention further includes an automatic system 51 for operating the valves and pumps described above to carry out all steps required for filling, running, and cleaning the chambered doctor blade assembly. The automated system 51 includes a programmable logic controller (PLC) 52 connected through a display driver 54 to a touch screen display 56. The display 56 serves as a graphical user interface by presenting system functions that are selectable by a user. The display 56 further acts as an input device by enabling the user to tap the portion of a screen display that corresponds to a chosen function, and the touch screen feeds the selection information back to the PLC 52. In addition, a non-volatile memory 53 that stores programming instructions and data values is connected to the PLC 52 to provide the proper screen displays and carry out the functions and choices portrayed by the screen displays.

The PLC 52 is also connected to operate the system pumps 57 (corresponding to the supply pump 124 and return pump 126 of FIG. 4), and the system valves (corresponding to the valves 102, 103, 109, 111, 117, 118, 122, 123, and 127). The PLC is also connected to operate the head loading valve 59 which, as described previously, controls the application of pneumatic pressure to the hydraulic fluid reservoir 37 that supplies the hydraulic cylinders 31 of the doctor blade mounting system. The PLC is further connected to appropriate sensors and limit switches that a prudent individual skilled in the art would include for safety and smooth operations. The stored programming of the PLC 52 is written to carry our the operating functions of the doctor blade system, including, but not limited to, the functions described in FIG. 11: Stop, Ink Purge, Ink Fill, Ink Running, Ink Drain, Water Rinse and Drain, Recirculate Wash and Drain, Injection Wash, and Water Rinse 2 and Drain 2.

Figure 1:
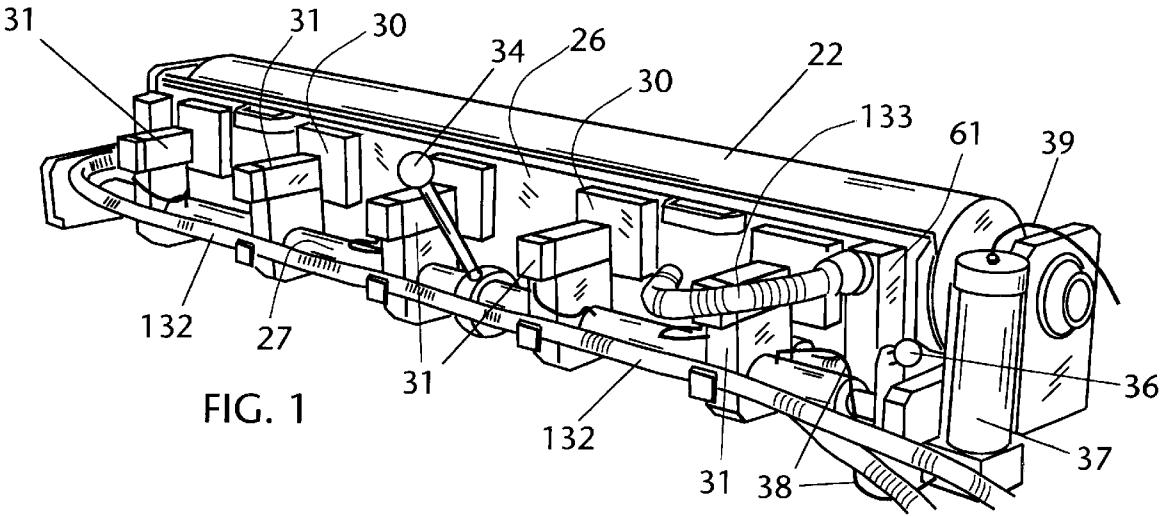
FIG. 1 is a perspective view of a chambered doctor blade mounted on a hydrostatically compensated hydraulic head loading assembly and connected to an automatic cleaning and refilling system.
Figure 2:
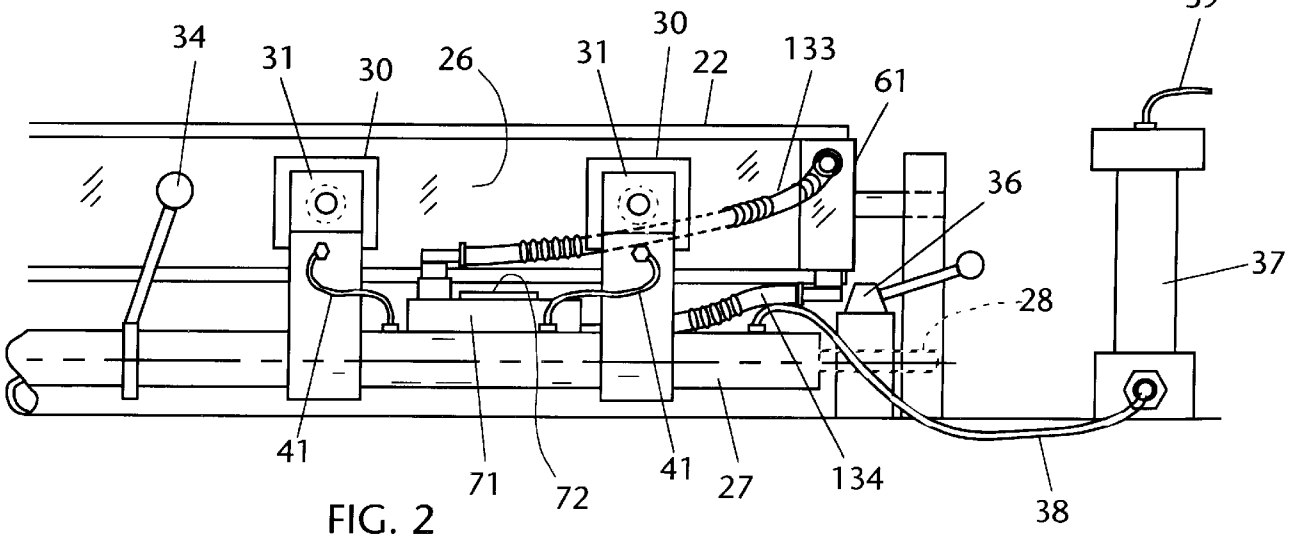
FIG. 2 is an enlarged partial plan elevation of the chambered doctor blade assembly as shown in FIG. 1.
Figure 9:
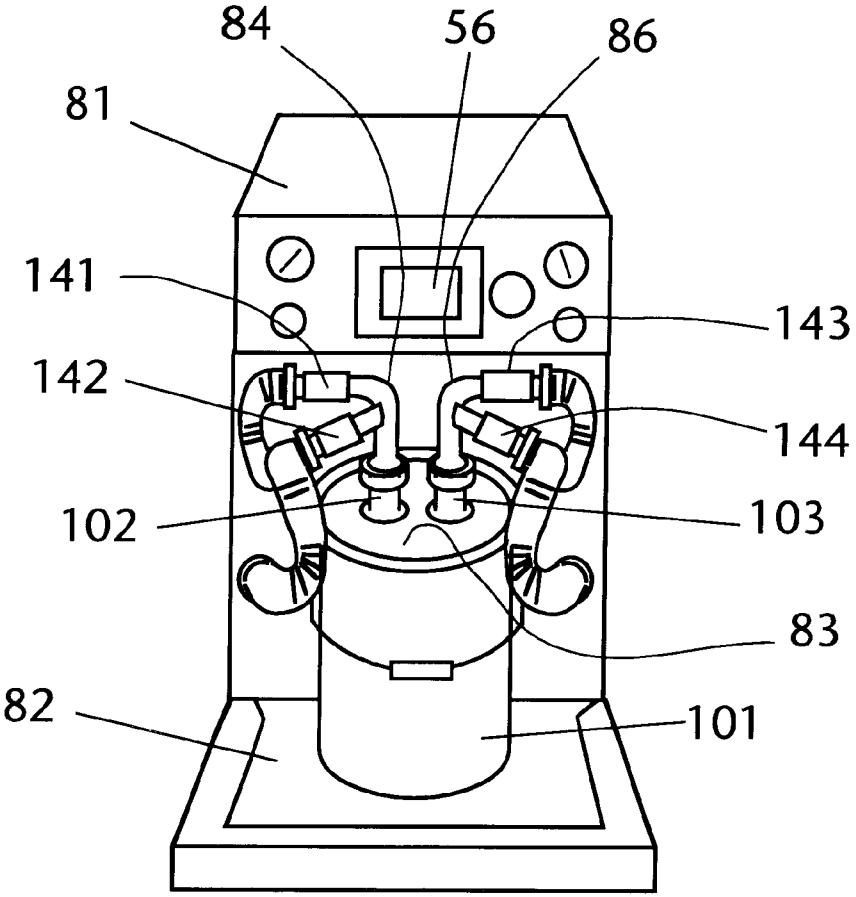
FIG. 9 is a front elevation of the console of the automatic cleaning and recharging system of the invention.

All of these functions may be carried out while the chambered doctor blade assembly 21 is engaged with the roller 22, whereby the roller is cleaned, washed, and inked at the same time as the remainder of the system undergoes these processes. As a result, the head loading valve 59 is On for all of the procedures except the Stop condition. The apparatus may further include an ambient port 71, as shown in FIGS. 1 and 2, that is interposed between the return line 133 and the valve 127. It has been observed that the chambered doctor blade assembly, when running against the transfer roller, may develop a suction adhesion to the transfer roller. When the system is switched to a function such as draining a liquid from the chamber 24, the vacuum in the chamber may prevent complete pump-out of the liquid. To overcome this effect, the ambient port 71 includes a flow channel having a top opening 72 that is open to atmosphere, as shown in FIG. 9, to maintain the return line to atmospheric pressure and releases any vacuum suction effects. The return pump may be operated at a slightly greater rate than the supply pump to assure that the flow thchannel does not overflow from opening 72.

Figure 7:
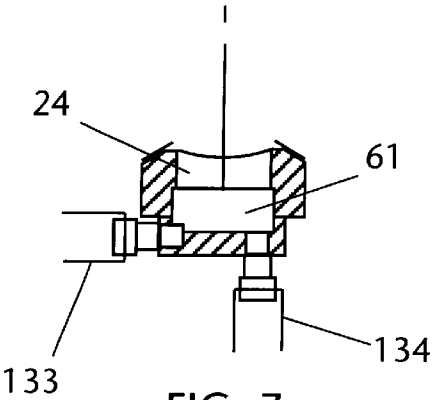
FIG. 7 is an enlarged cross-sectional detail of the doctor blade chamber connections to the return lines.

With regard to FIGS. 1, 2, and 7, the return lines 133 and 134 are connected to a manifold 61 secured to the return end of the chamber 24 of the doctor blade assembly 21. The connection of line 133 is used for circulating ink during a system run cycle, as it provides the smoothest fluid flow through the chamber, and both the connections of lines 133 and 134 are used to drain liquid out of the chamber 24, due to the fact that the connection of line 134 is at the bottom of the chamber when the system remains engaged with a transfer roller, as shown in FIGS. 1 and 2.

The mechanical components depicted in FIG. 4 and the electronic system of FIG. 5 may be incorporated into a small, portable console 81, as shown in FIG. 9. The console 81 is supported on casters, and includes a shelf extending outwardly from the front panel thereof to support the reservoir 101, depicted as a standard portable industrial container, such as a bucket having a lid 83. A pair of Y fittings 84 and 86 extend from the lid 83, the fitting 84 supporting quick disconnect fittings 141 and 142, and the fitting 86 supporting quick disconnect fittings 143 and 144. In addition, pinch valves 102 and 103 are secured in the lower stem portions of the fittings 84 and 86. The placement of these valves directly adjacent to the ink reservoir enables the cleaning and rinsing cycles to pump wash liquid and rinsing water through a maximum extent of the supply lines, whereby virtually the entire system may be cleaned and refilled without manual intervention. In addition, the lid may be removed, and a replacement bucket 101 installed with a new color ink or coating substance. In many instances, every other part of the draining, cleaning and refilling cycles are accomplished automatically, as described above. The touch screen display 56 is secured to an upper front panel portion, whereby the user may select a desired function for the system, and the function is carried out by the electronic system depicted in FIG. 5. The desired function may include a plurality of the procedures listed in FIG. 10, carried out sequentially to effect a complete job change for the transfer roller; i.e., ink purge and drain, water rinse and drain, recirculate wash and drain, injection wash, water rinse 2 and drain 2, and, thereafter, ink fill and ink running.

Thus the invention provides a system that automatically supplies ink to a chambered doctor blade assembly, while also loading the doctor blade assembly against a transfer roller with a self-compensating, pressure balanced mounting apparatus. The system further carries out typical printer or industrial job changing tasks, such as draining, cleaning, and rinsing the doctor blade assembly and the transfer roller, and further refilling the system and supplying the system for a further production run, all automatically.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

We claim:

1. An automated coating system comprising:

a chambered doctor blade assembly having a chamber adapted to supply a coating substance to a transfer roller;

a coating substance reservoir;

supply pump means for pumping the coating substance from said reservoir to the doctor blade chamber;

return pump means for drawing the coating substance from the doctor blade chamber and returning the coating substance to said reservoir;

valve means for controlling flow between said reservoir, said supply pump means, and said return pump means;

electronic control means programmed for selectively operating said supply pump means, said return pump means, and said valve means to circulate said coating substance to said chamber;

an hydraulic head loading system for releasably impinging the chambered doctor blade assembly on the transfer roller, said valve means connected also to control said hydraulic head loading system, and said electronic control means programmed also to operate said hydraulic head loading system;

said hydraulic head loading system including a plurality of hydraulic cylinders spaced along a length dimension of the doctor blade assembly, each hydraulic cylinder including a piston rod secured to the doctor blade assembly, and common manifold means for supplying hydraulic fluid to said hydraulic cylinders.

2. The automated system for operating a chambered doctor blade assembly of claim 1, wherein said electronic control means includes a programmable logic controller, and non-volatile memory means for storing programming instructions and data, said non-volatile memory means connected to said programmable logic controller.

3. The automated system for operating a chambered doctor blade assembly of claim 2, wherein said programmable logic controller includes output ports connected to said pump means and said valve means for selectively operating said pump means and said valve means sequentially according to said programming instructions.

4. The automated system for operating a chambered doctor blade assembly of claim 3, further including touch screen display means connected to said programmable logic controller to display a graphical user interface and receive touch commands.

5. An automated coating system comprising:

a chambered doctor blade assembly having a chamber adapted to supply a coating substance to a transfer roller;

a coating substance reservoir;

supply pump means for pumping the coating substance from said reservoir to the doctor blade chamber;

return pump means for drawing the coating substance from the doctor blade chamber and returning the coating substance to said reservoir;

valve means for controlling flow between said reservoir, said supply pump means, and said return pump means; and, electronic control means programmed for selectively operating said supply pump means, said return pump means, and said valve means to circulate said coating substance to said chamber;

a portable console for housing said supply pump means, said return pump means, said valve means, and said electronic control means;

said portable console includes means for removably supporting said coating substance reservoir;

said means for removably supporting comprising a shelf extending from said portable console.

6. The automated system for operating a chambered doctor blade assembly of claim 5, wherein said coating substance reservoir includes a removable top cover.

7. The automated system for operating a chambered doctor blade assembly of claim 6, further including a pair of Y-shaped fixtures extending from said top cover.

8. The automated system for operating a chambered doctor blade assembly of claim 7, wherein said Y-shaped fixtures each support a valve to isolate said reservoir from lines connected to said Y-shaped fixtures.

9. An automated coating system comprising:

a chambered doctor blade assembly having a chamber adapted to supply a coating substance to a transfer roller;

a coating substance reservoir;

supply pump means for pumping the coating substance from said reservoir to the doctor blade chamber;

return pump means for drawing the coating substance from the doctor blade chamber and returning the coating substance to said reservoir;

valve means for controlling flow between said reservoir, said supply pump means, and said return pump means;

electronic control means programmed for selectively operating said supply pump means, said return pump means, and said valve means to circulate said coating substance to said chamber;

an hydraulic head loading system including at least one hydraulic cylinder for releasably impinging the chambered doctor blade assembly on the transfer roller, said valve means connected also to control said hydraulic head loading system, and said electronic control means programmed also to operate said hydraulic head loading system.

10. The automated system for operating a chambered doctor blade assembly of claim 9, further including pneumatic means for pressurizing said the hydraulic fluid in said common manifold means by direct impingement of pressurized gas.

11. The automated system for operating a chambered doctor blade assembly of claim 9, further including a plurality of restricted flow orifices, each interposed between said common manifold means and a respective one of said hydraulic cylinders.

12. The automated system for operating a chambered doctor blade assembly of claim 9, wherein said valve means includes a reservoir supply valve at said coating substance reservoir, and a supply line connected between said reservoir supply valve and said supply pump means.

13. The automated system for operating a chambered doctor blade assembly of claim 12, further including a reservoir return valve at said coating substance reservoir, and a return line extending between said reservoir return valve and said return pump means.

14. The automated system for operating a chambered doctor blade assembly of claim 9, wherein said electronic control means includes a touch screen display for presenting a graphical user interface and receiving touch commands, said touch screen display being mounted on an upper exterior portion of said portable console.

15. An automated coating system comprising:

a chambered doctor blade assembly having a chamber adapted to supply a coating substance to a transfer roller;

a coating substance reservoir;

supply pump means for pumping the coating substance from said reservoir to the doctor blade chamber;

return pump means for drawing the coating substance from the doctor blade chamber and returning the coating substance to said reservoir;

valve means for controlling flow between said reservoir, said supply pump means, and said return pump means;

electronic control means programmed for selectively operating said supply pump means, said return pump means, and said valve means to circulate said coating substance to said chamber;

a water tank, and a water supply valve connected between said water tank and a supply line;

a first injection tank for holding a first concentrate solution, and a first concentrate supply valve connected between said first concentrate tank and said supply line;

a second wash tank for holding a second wash solution, and a second wash supply valve connected between said second wash tank and said supply line; and, a second wash return valve connected between said second wash tank and a return line.

16. The automated system for operating a chambered doctor blade assembly of claim 15, further including a waste valve connected between said return line and a waste discharge line.

17. The automated system for operating a chambered doctor blade assembly of claim 16, further including an ambient air vent valve connected to said supply line at an intake port thereof.

18. The automated system for operating a chambered doctor blade assembly of claim 15, further including a pair of drain lines connected between said return pump means and said chamber, said drain lines connected to the same end portion of said chamber and spaced apart to remove all liquid from said chamber.

19. The automated system for operating a chambered doctor blade assembly of claim 18, further including a chamber drain valve connected between said drain lines, said drain valve being openable for draining said chamber and closable for circulation of the coating substance through the chamber during application of a coating substance to the transfer roller.

20. The automated system for operating a chambered doctor blade assembly of claim 19, further including an ambient port interposed between said drain lines and said return pump means to maintain said drain line at atmospheric pressure.

* * * * *